US005595681A

United States Patent [19]

Panandiker et al.

[11] Patent Number: 5,595,681

[45] Date of Patent: Jan. 21, 1997

[54] LIQUID LAUNDRY DETERGENTS CONTAINING POLYAMINO ACID AND POLYALKYLENEGLYCOL

[75] Inventors: Rajan K. Panandiker; Yueqian Zhen, both of West Chester, Ohio

[73] Assignee: The Procter & Gamble Company, Cincinnati, Ohio

[21] Appl. No.: 469,742

[22] Filed: Jun. 6, 1995

Related U.S. Application Data

[63] Continuation of Ser. No. 166,748, Dec. 14, 1993, abandoned.

[51] Int. Cl.[6] ..... C11D 3/26; C11D 3/20

[52] U.S. Cl. ..... 510/299; 510/339; 510/341

[58] Field of Search ..... 252/174.23, 174.24, 252/546, DIG. 15, 173

[56] References Cited

U.S. PATENT DOCUMENTS

| | | | |
|---|---|---|---|
| 4,349,447 | 9/1982 | Noguchi et al. | 252/112 |
| 5,100,655 | 3/1992 | Takano et al. | 424/63 |
| 5,328,631 | 7/1994 | Du Vosel et al. | 252/174.23 |
| 5,332,528 | 7/1994 | Pan et al. | 252/548 |

FOREIGN PATENT DOCUMENTS

| | | |
|---|---|---|
| 0324595 | 7/1989 | European Pat. Off. . |
| 3724660 | 2/1988 | Germany . |
| 9306202 | 4/1993 | WIPO . |

*Primary Examiner*—Paul Lieberman
*Assistant Examiner*—Kery Fries
*Attorney, Agent, or Firm*—George W. Allen; Jerry J. Yetter

[57] ABSTRACT

Liquid laundry detergents containing an improved biodegradable clay soil removal/anti-deposition agent which is a mixture of a polyamino acid (or a salt thereof) and a polyalkylene glycol.

4 Claims, No Drawings

LIQUID LAUNDRY DETERGENTS CONTAINING POLYAMINO ACID AND POLYALKYLENEGLYCOL

This is a continuation of application Ser. No. 08/166,748, filed on Dec. 14, 1993 abandoned.

FIELD OF THE INVENTION

The invention relates to liquid laundry detergents containing a highly effective and biodegradable clay soil removal/anti-deposition agent.

BACKGROUND

An important performance feature in laundry detergents is the ability to remove clay-type soils from fabrics and to keep soils in suspension so they do not deposit on fabrics during the washing process. The prior an reveals numerous materials (usually referred to as antideposition agents or co-builders) which have been used for this purpose. For example, U.S. Pat. No. 4,407,722, Davies et al., issued Oct. 4, 1983 discloses, inter alia salts of homo- or copolymers of acrylic acid or substituted acrylic acid, ethylene maleic anhydride copolymers, polyitaconic acid, certain phosphate esters, diphosphonate salts such as ethane-1-hydroxy-1,1 diphosphonate and salts of polyaspartic acid as antideposition agents.

U.S. Pat. No. 4,490,217, Spadini et al., issued Dec. 25, 1984 discloses the use of mixtures of polyethylene glycol and polyacrylate polymer to achieve a high level of clay-soil removal and anti-deposition performance in detergent compositions built with non-phosphorous builders such as zeolites, sodium carbonate and polycarboxylic acids (e.g., nitrilotriacetic acid, oxydisuccinic acid, etc.).

Polyamino acids and their salts are particularly desirable clay soil removal/antideposition agents for use in detergents because they are highly biodegradable (see European Application EP 454,126, published Oct. 30, 1991). While providing excellent performance in granular detergents, their performance in liquid laundry detergents is somewhat deficient. This is believed to be mainly due to the typically lower pH (usually about 7 to 8.5) of the liquid products.

The object of the present invention is to improve the clay soil removal/anti-deposition performance of polyamino acids (and their salts) in liquid laundry detergents.

All percentages and proportions herein are "by weight" unless specified otherwise.

SUMMARY OF THE INVENTION

The present invention is an agent for imparting improved clay soil removal/antideposition performance to liquid laundry detergents. The agent comprises a mixture of a polyamino acid or salt thereof, and polyalkylene glycol. The invention also includes liquid laundry detergents containing said agent.

DESCRIPTION OF THE INVENTION

In accordance with the present invention, the clay soil removal/antideposition performance of polyamino acids or salts thereof (hereinafter "PAA's), when formulated into heavy duty liquid laundry detergents, is significantly improved when a polyalkylene glycol (PAG) selected from polyethylene glycol, polypropylene glycol and copolymers of ethylene glycol/propylene glycol is also present.

Accordingly, in its broadest aspect the present invention is a clay soil removal/antideposition agent comprising a mixture of PAA:PAG in a weight ratio of PAA to PAG of from about 1:1 to about 1:7. The invention also comprises liquid laundry detergent compositions which comprise a surfactant, a detergency builder and the aforementioned mixture of PAA and PAG.

The Clay Soil Removal/Antiredeposition Agent

The PAA's used herein have the following formula:

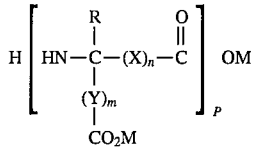

wherein R is H or $C_1$–$C_4$ alkyl, X and Y can be the same or different and are selected from $C_1$–$C_4$ alkylene, phenylene, substituted alkylene, or substituted phenylene, the substituents being selected from halogen, nitro or hydroxyl, m and n are the same or different and are 0 or 1, p is from about 12 to about 350 (preferably from about 20 to about 120) and M is hydrogen or a neutralizing cation such as alkali metal (e.g., sodium or potassium) ammonium or substituted ammonium (e.g., triethanolammonium).

The molecular weight of the PAA's herein (based on the acid form) is typically from about 5000 to about 35,000, and is preferably in the range of from about 8000 to about 12,000. Examples of polyamino acids suitable for use herein are polymers (or copolymers with each other) of the following amino acids: aspartic acid, glutamic acid, 2-hydroxyglutamic acid, 3-aminopentanedioic acid, 2-aminohexanedioic acid, 3-amino-3-(4-carboxy)phenyl propionic acid, and 3-amino-3-(2-nitro-4-carboxy)phenyl propionic acid. The preferred polyamino acids are polyaspartic acid, polyglutamic acid and copolymers of aspartic/glutamic acid.

The PAA's can be prepared by known methods such as described in Sela et al., J.A.C.S. 75:6350 (1953), Idelson, et al., J.A.C.S. 80:4631 (1958), Sandek et al., Biopolymers, 20:1615 (1981), Haroda et al., J.A.C.S. 80, 2694 (1958) incorporated herein by reference. Preparation of polyaspartic acid by reaction of maleic acid and ammonia is described in U.S. Pat. No. 4,839,461, Boemke, also incorporated by reference.

Polyalkylene glycols are readily available in a wide range of molecular weights from various commercial sources. The PAG's used according to the present invention should have a molecular weight of from about 500 to about 10,000, preferably from about 1000 to about 8000 and most preferably from about 3400 to about 4000. Polyethylene glycol is the preferred material.

The ratio of PAA to PAG should be from about 1:1 to about 1:7, preferably from about 1:3 to about 1:5. The PAA/PAG clay soil removal antideposition agent is used in the liquid laundry detergent compositions herein at a level of from about 0.1% to about 20%, preferably about 0.5% to about 10%.

Heavy Duty Liquid Detergent Compositions

In addition to the clay soil removal/antideposition agent described above, the heavy duty liquid laundry detergent compositions herein comprise a surfactant, a detergency builder and a liquid medium.

From about 1% to 80%, preferably about 3% to 50%, most preferably about 10% to 30%, of surfactant is an essential ingredient in detergent compositions of the present invention. The surfactant can be selected from the group consisting of anionics, nonionics, cationics, ampholytics, zwitterionics, and mixtures thereof. Anionic and nonionic surfactants are preferred.

Alkyl sulfate surfactants, either primary or secondary, are a type of anionic surfactant of importance for use herein. Alkyl sulfates have the general formula $ROSO_3M$ wherein R preferably is a $C_{10}$–$C_{24}$ hydrocarbyl, preferably a alkyl straight or branched chain or hydroxyalkyl having a $C_{10}$–$C_{20}$ alkyl component, more preferably a $C_{12}$–$C_{18}$ alkyl or hydroxyalkyl, and M is H or a cation, e.g., an alkali metal cation (e.g., sodium potassium, lithium), substituted or unsubstituted ammonium cations such as methyl-, dimethyl-, and trimethyl ammonium and quaternary ammonium cations, e.g., tetramethyl-ammonium and dimethyl piperdinium, and cations derived from alkanolamines such as ethanolamine, diethanolamine, triethanolamine, and mixtures thereof, and the like. Typically, alkyl chains of $C_{12-16}$ are preferred for lower wash temperatures (e.g., below about 50° C.) and $C_{16-18}$ alkyl chains are preferred for higher wash temperatures (e.g., about 50° C.).

Alkyl alkoxylated sulfate surfactants are another category of useful anionic surfactant. These surfactants are water soluble salts or acids typically of the for formula $RO(A)_mSO_3M$ wherein R is an unsubstituted $C_{10}$–$C_{24}$ alkyl or hydroxyalkyl group having a $C_{10}$–$C_{24}$ alkyl component, preferably a $C_{12}$–$C_{20}$ alkyl or hydroxyalkyl, more preferably $C_{12}$–$C_{18}$ alkyl or hydroxyalkyl, A is an ethoxy or propoxy unit, m is greater than zero, typically between about 0.5 and about 6, more preferably between about 0.5 and about 3, and M is H or a cation which can be, for example, a metal cation (e.g., sodium, potassium, lithium, calcium, magnesium, etc.), ammonium or substituted-ammonium cation. Alkyl ethoxylated sulfates as well as alkyl propoxylated sulfates are contemplated herein. Specific examples of substituted ammonium cations include methyl-, dimethyl-, trimethylammonium and quaternary ammonium cations, such as tetramethyl-ammonium, dimethyl piperdinium and cations derived from alkanolamines, e.g., monoethanolamine, diethanolamine, and triethanolamine, and mixtures thereof. Exemplary surfactants are $C_{12}C_{18}$ alkyl polyethoxylate (1.0) sulfate, C12–$C_{18}$ alkyl polyethoxylate (2.25) sulfate, $C_{12}$–$C_{18}$ alkyl polyethoxylate (3.0) sulfate, and $C_{12}$–$C_{18}$ alkyl polyethoxylate (4.0) sulfate wherein M is conveniently selected from sodium and potassium.

Other anionic surfactants useful for detersive purposes can also be included in the compositions hereof. These can include salts (including, for example, sodium potassium, ammonium, and substituted ammonium salts such a mono-, di- and triethanolamine salts) of soap, $C_9$–$C_{20}$ linear alkylbenzenesulphonates, $C_8$–$C_{22}$ primary or secondary alkanesulphonates, $C_8$–$C_{24}$ olefinsulphonates, sulphonated polycarboxylic acids, alkyl glycerol sulfonates, fatty acyl glycerol sulfonates, fatty oleyl glycerol sulfates, alkyl phenol ethylene oxide ether sulfates, paraffin sulfonates, alkyl phosphates, isothionates such as the acyl isothionates, N-acyl taurates, fatty acid amides of methyl tauride, alkyl succinamates and sulfosuccinates, monoesters of sulfosuccinate (especially saturated and unsaturated $C_{12}$–$C_{18}$ monoesters) diesters of sulfosuccinate (especially saturated and unsaturated $C_6$–$C_{14}$ diesters), N-acyl sarcosinates, sulfates of alkylpolysaccharides such as the sulfates of alkylpolyglucoside, branched primary alkyl sulfates, alkyl polyethoxy carboxylates such as those of the formula $RO(CH_2CH_2O)_kCH_2COO—M^+$ wherein R is a $C_8$–$C_{22}$ alkyl, k is an integer from 0 to 10, and M is a soluble salt-forming cation, and fatty acids esterified with esethionic acid and neutralized with sodium hydroxide. Further examples are given in *Surface Active Agents and Detergents* (Vol. I and II by Schwartz, Perry and Berch).

Nonionic surfactants such as block alkylene oxide condensate of $C_6$ to $C_{12}$ alkyl phenols, alkylene oxide condensates of $C_8$–$C_{22}$ alkanols and ethylene oxide/propylene oxide block polymers (Pluronic™—Union Carbide), as well as semi polar nonionics (e.g., amine oxides and phosphine oxides) can be used in the present compositions. An extensive disclosure of these types of surfactants is found in U.S. Pat. No. 3,929,678, Laughlin et al., issued Dec. 30, 1975, incorporated herein by reference.

Ampholytic and zwitterionic surfactants such as described in U.S. Pat. No. 3,929,678, supra can also be used in the compositions of the invention.

Cationic surfactants suitable for use in the compositions herein are described in U.S. Pat. No. 4,228,044 Cambre, issued Oct. 14, 1980, incorporated by reference herein.

Alkylpolysaccharides such as disclosed in U.S. Pat. No. 4,565,647 Llenado (incorporated by reference herein) can be used as surfactants in the compositions of the invention.

Polyhydroxy fatty acid amides can be used as surfactants herein.

These materials have the formula:

$$R^2—\overset{\overset{\displaystyle O}{\|}}{C}—\overset{\overset{\displaystyle R^1}{|}}{N}—Z$$

wherein: $R^1$ is H, $C_1$–$C_4$ hydrocarbyl, 2-hydroxy ethyl, 2-hydroxy propyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{31}$ hydrocarbyl, preferably straight chain $C_7$–$C_{19}$ alkyl or alkenyl, more preferably straight chain $C_9$–$C_{17}$ alkyl or alkenyl, most preferably straight chain $C_{11}$–$C_{15}$ alkyl or alkenyl, or mixtures thereof; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z preferably will be derived from a reducing sugar in a reductive amination reaction; more preferably Z will be a glycityl. Suitable reducing sugars include glucose, fructose, maltose, lactose, galactose, mannose, and xylose. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)_n—CH_2OH$, $—CH(CH_2OH)—(CHOH)_{n-1}—CH_2OH$, $—CH_2—(CHOH)_2(CHOR')(CHOH)—CH_2OH$, and alkoxylated derivatives thereof, where n is an integer from 3 to 5, inclusive, and R' is H or a cyclic or aliphatic monosaccharide. Most preferred are glycityls wherein n is 4, particularly $—CH_2—(CHOH)_4—CH_2OH$.

In the above formula, R' can be, for example, N-methyl, N-ethyl, N-propyl, N-isopropyl, N-butyl, N-2-hydroxy ethyl, or N-2-hydroxy propyl.

$R^2CO—N<$ can be, for example, cocamide, stearamide, oleamide, lauramide, myristamide, capricamide, palmitamide, tallowamide, etc.

Z can be 1-deoxyglucityl, 2-deoxyfructityl, 1-deoxymaltityl, 1-deoxylactityl, 1-deoxygalactityl, 1-deoxymannityl, 1-deoxymaltotriotityl, etc.

A particularly desirable surfactant of this type for use in the compositions herein is alkyl-N-methyl glucomide, a compound of the above formula wherein $R_2$ is alkyl (preferably $C_{11}$–$C_{13}$), R, is methyl and Z is 1-deoxyglucityl.

From 1% to about 50%, preferably about 3% to 30%, more preferably about 5% to 20% detergency builder is included in the composition herein. Inorganic as well as organic builders can be used.

Inorganic detergency builders include, but are not limited to, the alkali metal, ammonium and alkanolammonium salts of polyphosphates (exemplified by the tripolyphosphates, pyrophosphates, and glassy polymeric meta-phosphates), phosphonates, phytic acid, silicates, carbonates (including bicarbonates and sesquicarbonates), sulphates, and aluminosilicates. Borate builders, as well as builders containing borate-forming materials that can produce borate under detergent storage or wash conditions (hereinafter, collectively "borate builders"), can also be used. Preferably, non-borate builders are used in the compositions of the invention intended for use at wash conditions less than about 50° C., especially less than about 40° C.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck, incorporated herein by reference. However, other silicates may also be useful such as for example magnesium silicate, which can serve as a stabilizing agent for oxygen bleaches, and as a component of suds control systems.

Examples of carbonate builders are the alkaline earth and alkali metal carbonates, including sodium carbonate and sesquicarbonate and mixtures thereof.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula:

$$M_z(zAlO_2 \cdot ySiO_2)$$

wherein M is sodium, potassium, ammonium or substituted ammonium, z is from about 0.5 to about 2; and y is 1; this material having a magnesium ion exchange capacity of at least about 50 milligram equivalents of $CaCO_3$ hardness per gram of anhydrous aluminosilicate. Preferred aluminosilicates are zeolite builders which have the formula:

$$Na_z[(AlO_2)_z\ (SiO_2)_y] \cdot xH_2O$$

wherein z and y are integers of at least 6, the molar ratio of z to y is in the range from 1.0 to about 0.5, and x is an integer from about 15 to about 264.

Specific examples of polyphosphates are the alkali metal tripolyphosphates, sodium, potassium and ammonium pyrophosphate, sodium and potassium and ammonium pyrophosphate, sodium and potassium orthophosphate, sodium polymeta phosphate in which the degree of polymerization ranges from about 6 to about 21, and salts of phytic acid.

Organic detergent builders preferred for the purposes of the present invention include a wide variety of polycarboxylate compounds. As used herein, "polycarboxylate" refers to compounds having a plurality of carboxylate groups, preferably at least 3 carboxylates.

Polycarboxylate builder can generally be added to the composition in acid form, but can also be added in the form of a neutralized salt. When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates. A number of ether polycarboxylates have been disclosed for use as detergent builders. Examples of useful ether poly-carboxylates include oxydisuccinate, as disclosed in Berg, U.S. Pat. No. 3,128,287, issued Apr. 7, 1964, and Lamberti et al., U.S. Pat. No. 3,635,830, issued Jan. 18, 1972, both of which are incorporated herein by reference.

A specific type of ether polycarboxylates useful as builders in the present invention also include those having the general formula:

$$CH(A)(COO\ X)—CH(COO\ X)—O—CH(COO\ X)—CH(COOX)(B)$$

wherein A is H or OH; B is H or —O—CH(COOX)—$CH_2$(COOX); and X is H or a salt-forming cation. For example, if in the above general formula A and B are both H, then the compound is oxydissuccinic acid and its water-soluble salts. If A is OH and B is H, then the compound is tartrate monosuccinic acid (TMS) and its water-soluble salts. If A is H and B is —O—CH(COOX)—$CH_2$(COOX), then the compound is tartrate disuccinic acid (TDS) and its water-soluble salts. Mixtures of these builders are especially preferred for use herein. Particularly preferred are mixtures of TMS and TDS in a weight ratio of TMS to TDS of from about 97:3 to about 20:80. These builders are disclosed in U.S. Pat. No. 4,663,071, issued to Bush et al., on May 5, 1987.

Suitable ether polycarboxylates also include cyclic compounds, particularly alicyclic compounds, such as those described in U.S. Pat. Nos. 3,923,679; 3,835,163; 4,158,635; 4,120,874 and 4,102,903, all of which are incorporated herein by reference.

Other useful detergency builders include the ether hydroxypolycarboxylates represented by the structure:

$$HO[C(R)(COOM)—C(R)(COOM)—O]_n—H$$

wherein M is hydrogen or a cation wherein the resultant salt is water-soluble, preferably an alkali metal, ammonium or substituted ammonium cation, n is from about 2 to about 15 (preferably n is from about 2 to about 10, more preferably n averages from about 2 to about 4) and each R is the same or different and selected from hydrogen, $C_{1-4}$ alkyl or $C_{1-4}$ substituted alkyl (preferably R is hydrogen).

Still other ether polycarboxylates include copolymers of maleic anhydride with ethylene or vinyl methyl ether, 1,3,5-trihydroxy benzene-2,4,6-trisulphonic acid, and carboxymethyloxysuccinic acid.

Organic polycarboxylate builders also include the various alkali metal, ammonium and substituted ammonium salts of polyacetic acids. Examples include the sodium, potassium, lithium, ammonium and substituted ammonium salts of ethylenediamine tetraacetic acid, and nitrilotriacetic acid.

Also included are polycarboxylates such as mellitic acid, succinic acid, oxydisuccinic acid, polymaleic acid, benzene 1,3,5-tricarboxylic acid, and carboxymethyloxysuccinic acid, and soluble salts thereof.

Citrate builders, e.g., citric acid and soluble salts thereof (particularly sodium salt), are suitable polycarboxylate builders for the compositions herein.

Other carboxylate builders include the carboxylated carbohydrates disclosed in U.S. Pat. No. 3,723,322, Diehl, issued Mar. 28, 1973, incorporated herein by reference.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986, incorporated herein by reference.

Useful succinic acid builders include the $C_5$–$C_{20}$ alkyl succinic acids and salts thereof. A particularly preferred compound of this type is dodecenyl-succinic acid. Alkyl succinic acids typically are of the general formula R—CH(COOH)$CH_2$(COOH) i.e., derivatives of succinic acid, wherein R is hydrocarbon, e.g., $C_{10}$–$C_{20}$ alkyl or alkenyl, preferably $C_{12}$–$C_{16}$ or wherein R may be substituted with hydroxyl, sulfo, sulfoxy or sulfone substituents, all as described in the above-mentioned patents.

The succinate builders are preferably used in the form of their water-soluble salts, including the sodium, potassium, ammonium and alkanolammonium salts.

Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group.

Another type of useful builder consists of ethylenediamine disuccinic acid and the alkali metal and ammonium salts thereof. See U.S. Pat. No. 4,704,233, Hartman et al., incorporated herein by reference.

Examples of useful builders also include sodium and potassium carboxymethyloxymalonate, carboxymethyloxysuccinate, ciscyclohexanehexacarboxylate, ciscyclopentanetetracarboxylate, and the copolymers of maleic anhydride with vinyl methyl ether or ethylene.

Other suitable polycarboxylates are the polyacetal carboxylates disclosed in U.S. Pat. No. 4,144,226, Crutchfield et al., issued Mar. 13, 1979, incorporated herein by reference. These polyacetal carboxylates can be prepared by bringing together, under polymerization conditions, an ester of glyoxylic acid and a polymerization initiator. The resulting polyacetal carboxylate ester is then attached to chemically stable end groups to stabilize the polyacetal carboxylate against rapid depolymerization in alkaline solution, and converted to the corresponding salt.

Polycarboxylate builders are also disclosed in U.S. Pat. No. 3,308,067, Diehl, issued Mar. 7, 1967, incorporated herein by reference. Such materials include the water-soluble salts of homo- and copolymers of aliphatic carboxylic acids such as maleic acid, itaconic acid, mesaconic acid, fumaric acid, aconitic acid, citraconic acid and methylenemalonic acid.

A particularly desirable builder system for use herein is one comprising a mixture of a $C_{10}$–$C_{18}$ monocarboxylic acid (i.e., fatty acid) and citric acid or a salts thereof. When using this system, the composition will preferably contain from about 1% to about 18% of the monocarboxylic acid and from about 0.2% to 10% of the citric acid or citrate salt.

When salts of carboxylate builders are used they are typically the alkali metal (e.g., Na), or amine (e.g., methyl amine, monoethanol amine, diethanolamine, etc.) salts. The liquid medium of the compositions herein is typically water, but may be a mixture of water and organic solvents which are miscible with water. Examples of the latter are ethanol, propanol, isopropanol, ethylene glycol, propylene glycol and glycerine. The liquid medium typically comprises from about 10% to 70%, preferably about 20% to 60%, most preferably about 40 to 50% of the composition. Preferably the compositions are formulated so as to have a pH of from about 6.5 to 11.0 (preferably 7.0 to 8.5) when measured at a concentration of 10% in water. Control of pH can be achieved by use of buffers, alkalis and acids as well known to those skilled in the art. The compositions herein can contain various optional ingredients. These include soil release agents, optical brighteners, hydrotropes, enzymes, bleaches, bleach activators, and suds suppressors.

The invention will be illustrated by the following examples, which are not in any way to be construed as limitations on the claimed inventions.

EXAMPLE I

A liquid heavy duty laundry detergent of the invention is made according to the following formula:

| | |
|---|---|
| $C_{14-15}$ alkyl polyethoxylate (2.25) acid sulfate | 18.0% |
| $C_{12-13}$ alkyl polyethoxylate (6.5) | 2.0 |
| $C_{12-14}$ N-methylglucamide | 6.0 |
| Citric acid | 4.0 |
| $C_{14}$ fatty acid | 2.0 |
| Ethanol-40B | 4.0 |
| 1,2-propanediol | 7.0 |
| Monoethanolamine | 1.0 |
| Optical brightener | 0.1 |
| Soil release polymer[1] | 0.30 |
| Boric acid | 2.50 |
| Protease | 1.40 |
| Lipase | 0.18 |
| Polyethylene glycol (MW 4000) | 1.5 |
| Polyaspartic acid (MW 10,000) | 0.5 |
| Water and NaOH[2] | Balance |

[1]Ethoxylated copolymer of polyethylene-polypropylene terephthalate polysulfonic acid.
[2]Sufficient NaOH is used to neutralize the acidic materials used in preparing the composition and to produce a pH of about 8.0 when the finished composition is dissolved in water at a concentration of 10%.

The composition is prepared according to the following procedure: The alkyl polyethoxylate acid sulfate is first mixed thoroughly with monoethanolamine, NaOH and alkyl polyethyoxylate. Then, boric acid, fatty acid and citric acid are added slowly while the solution is being stirred rapidly to reach a pH around 8.0. The N-methyl glucamide, brightener, soil release polymer, polyethylene glycol, and polyaspartic acid (sodium sa10 are added. NaOH is used to finally adjust the pH to 8.0 at 10% concentration in water.

After the temperature is lowered, protease and lipase are added. Water is added finally to achieve the final target.

Ethanol and propylene glycol are present in the sulfated alkyl ethoxylate and N-methyl glucamide surfactants which are used in the composition.

A similar composition is obtained by substituting polyglutamic acid or a copolymer of polyglutamic/polyaspartic acid for polyaspartic acid in this example.

What is claimed is:

1. A liquid laundry detergent composition containing an especially effective clay soil removal/antideposition agent, which composition comprises:

i) from about 1% to about 80% of surfactant;

ii) from about 1% to about 50% of an organic or inorganic detergency builder iii) from about 0.1% to about 20% of a clay soil removal/antideposition agent, said agent comprising a mixture of:

(a) a polyamino acid or salt thereof selected from the group consisting of polyaspartic acid, and salts thereof; and (b) polyethylene glycol having a molecular weight of from about 3400 to about 4000;

the weight ratio of (a) to (b) being from about 1:3 to about 1:5 and;

iv) from about 10% to about 70% of a liquid medium.

2. The composition of claim 1 wherein the level of Component i. is from about 10% to about 30% and the level of Component ii. is from about 3% to about 30%.

3. The composition of claim 2 wherein the level of Component iii. is from about 0.5% to about 10%.

4. The composition of any one of claim 3, wherein in Component iii. the molecular weight of a) is from about 8000 to about 12,000, based on the acid form.

* * * * *